United States Patent [19]

Marotto

[11] 4,071,215

[45] Jan. 31, 1978

[54] VENETIAN BLIND HEADRAIL BRACKET

[75] Inventor: Anthony F. Marotto, Philadelphia, Pa.

[73] Assignee: Marathon Manufacturing Company, Houston, Tex.

[21] Appl. No.: 728,607

[22] Filed: Oct. 1, 1976

[51] Int. Cl.[2] ..... B61L 11/08

[52] U.S. Cl. ..... 248/251; 248/264

[58] Field of Search ..... 248/264, 251, 265; 160/178 B

[56] References Cited

U.S. PATENT DOCUMENTS

| | | | |
|---|---|---|---|
| 2,670,167 | 2/1954 | Nelson | 248/264 |
| 2,680,589 | 6/1954 | Nelson | 248/264 |
| 2,703,694 | 8/1955 | Wright et al. | 248/264 |
| 2,792,999 | 5/1957 | Lorentzen | 248/264 |
| 2,916,246 | 12/1959 | Radel | 248/264 |
| 3,011,748 | 12/1961 | Breuer | 248/265 |

*Primary Examiner*—Roy D. Frazier
*Assistant Examiner*—Peter A. Aschenbrenner
*Attorney, Agent, or Firm*—Robert K. Youtie

[57] ABSTRACT

A bracket for a venetian blind headrail comprising a side opening box-like structure having means for mounting to a window frame, a swingably openable front cover on the structure, and a forward upstanding retaining lip on the bottom wall for retaining the supported end of a headrail on the bottom wall.

4 Claims, 3 Drawing Figures

FIG. 1
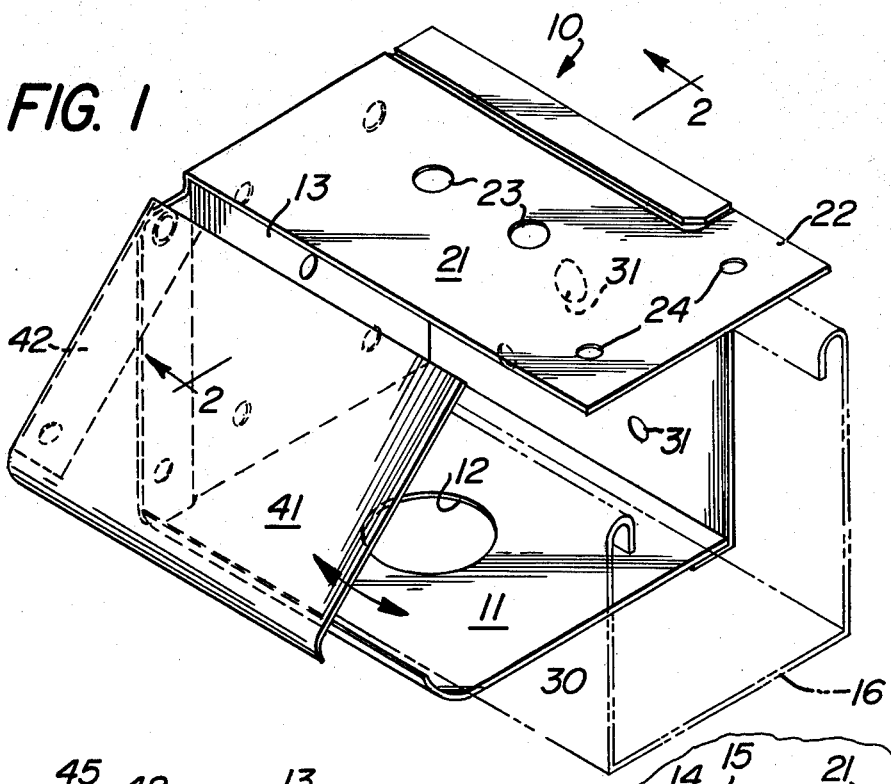
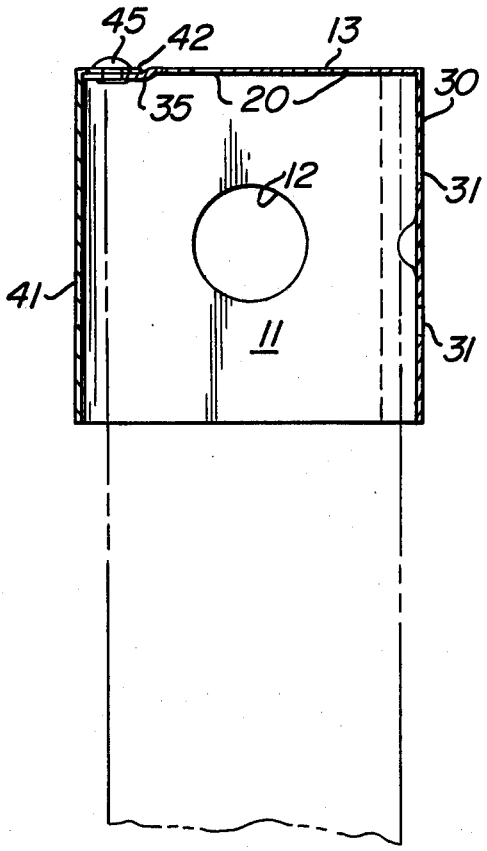
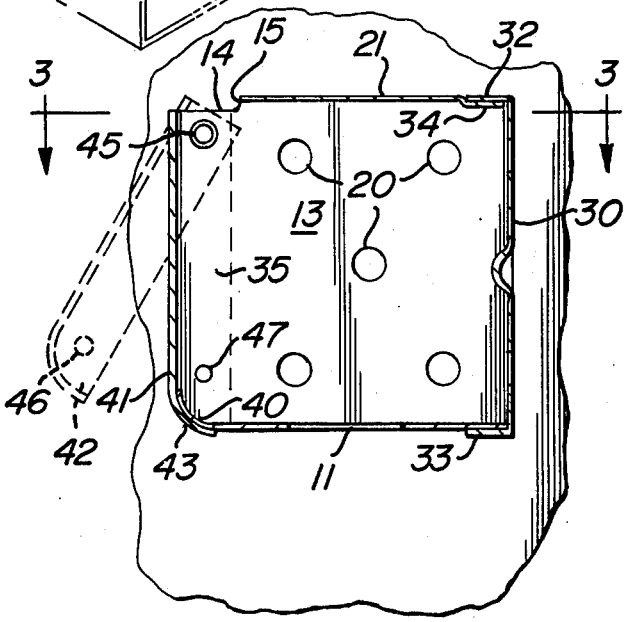
FIG. 2
FIG. 3

VENETIAN BLIND HEADRAIL BRACKET

BACKGROUND OF THE INVENTION

In the past, a variety of headrail brackets have been proposed, usually including a forwardly opening structure for receiving the headrail, and having a front closure serving to retain the headrail. However, in the past such front closures have necessarily relied upon the diligentness of the installer to prevent accidental removal and falling of the headrail and blind. That is, failure to properly and completely close the front cover, sufficiently to latch or lock the same, often subjected a venetian blind operator to the hazard of head and other injuries occasioned by a falling blind. That is, the pull exerted on the blind cords was often enough to slide the headrail forwardly through the front opening headrail bracket to fall and possibly cause injury.

SUMMARY OF THE INVENTION

It is, therefore, an important object of the present invention to provide a headrail bracket for venetian blinds which completely overcomes the above-mentioned difficulties, positively restrains a venetian blind headrail from falling, even without closure of the bracket front cover.

It is another object of the present invention to provide a headrail bracket of the type described which is versatile in installation in a wide variety of situations, is extremely simple and staunch in structure, and adapted for attractive aesthetic appearance.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a headrail bracket of the present invention, and partially illustrating, in phantom, a headrail associated with the bracket.

FIG. 2 is a vertical sectional view taken generally along the line 2—2 of FIG. 1.

FIG. 3 is a horizontal sectional view taken generally along the line 3—3 of FIG. 2.

DESCRIPTION OF THE PREFERRED EMBODIMENT

Referring now more particularly to the drawings, and specifically to FIG. 1 thereof, a headrail bracket of the present invention is there generally designated 10, and is shown as supporting a headrail 16, illustrated in phantom.

The bracket 10 may be integrally fabricated of a single sheet of metal suitably blanked and bent, or otherwise fabricated if desired. The bracket is of a generally box-like configuration, open on one side for extension therethrough of the headrail.

More specifically, the bracket includes a generally rectangular bottom wall 11, which may have a generally central access opening 12. Upstanding from one side edge of the bottom wall 11, integral therewith, is a generally rectangular side or end wall 13. The side wall 13 is generally normal to the bottom wall 11, having its lower edge coextensive with the side edge of the bottom wall. The upper forward corner of the side wall 13 may be generally rectangularly cut away or notched, to define a generally horizontal edge 14 extending rearwardly from the forward edge of the side wall 13, spaced below the upper edge thereof, and a generally vertical edge 15 extending upwardly from the rear end of horizontal edge 14 to the upper edge of the side wall. The side wall is advantageously provided with a plurality of through openings, as at 20, for receiving fasteners, as in mounting the bracket 10 on a vertical side wall.

A top wall 21 is disposed generally horizontally in parallel spaced relation over the bottom wall 11, extending from the upper edge of side wall 13, as between the rear edge thereof and the upper end of vertical notch edge 15. The top wall 21 is generally rectangular, and extends from the side wall 13 over the bottom wall 11 and beyond the latter, as by an extending top wall portion 22. Suitable mounting means, as in the nature of fastener receiving openings may be formed in the top wall 21, say openings 23 located generally over access hole 12 of bottom wall 11, and additional openings 24 in the extending portion 22 of the top wall.

In addition, a generally rectangular back wall 30 may extend integrally from the rear edge of side wall 13, coextensive therewith, along the rear edge of bottom wall 11, coterminus with the latter, and vertically to the top wall 21. The back or rear wall 30 is also provided with mounting means in the form of fastener receiving openings, as at 31, as for fastening the bracket to a forwardly facing vertical surface. In addition, the rear wall 30 is provided along its upper and lower edges with respective inturned upper and lower lips or flanges 32 and 33 which respectively overlap and reinforce the upper and lower walls 21 and 11. If desired, the flanges 32 and 33 may be secured, as by welding, or otherwise, to their respective adjacent upper and lower walls 21 and 11. However, for usual installations this is not necessary.

It is advantageous that the top wall 21, along its rear edge, be depressed, as at 34, to receive the flange 32 with the latter substantially coplanar with the remainder of the top wall. This facilitates horizontal mounting with the top wall in facing engagement with a downwardly facing, horizontal mounting surface.

Also, the side wall 13 advantageously has its forward edge portion 35 depressed or recessed inwardly, as between the vertical edge 15 and the forward edge of the side wall. This provides an external recess in the side wall 13, for a purpose appearing presently.

The bottom wall 11 is formed, integrally therewith, to include along its forward edge a horizontally extending, upstanding flange or lip 40, which may be longitudinally coextensive with the forward edge of the bottom wall. The lip 40 upstands generally along the forward edge of the side wall 13.

A front wall or cover 41 is composed of a generally rectangular sheet laterally coextensive with the bottom wall 11, and extending vertically from the bottom wall approximately to the level of the horizontal edge 14 of the side wall cutout. The front wall or cover 41 is provided along one side edge adjacent to the side wall 13 with a flange or extension 42 adapted to be positioned within the external recess defined by depressed side portion 35 when the front cover is in its vertical, closed position. Thus, the side extension or flange is generally congruent to and vertically coextensive with the depressed side wall portion 35, terminating at its upper edge contiguous to the horizontal notch edge 14. Along the lower edge of front wall or cover 41, there may be a rearwardly or inwardly turned lip 43, laterally coextensive with the front wall, so as to overlie the retaining lip 40 when the front wall 41 is in its vertical closed position.

Mounting the vertical wall 41 for swinging movement is a rivet, eyelet or other pivot means 45 extending through upper regions of the flange 42 and the recessed side wall portion 35. The axis of the pivot means 45 is generally horizontal, so that the front wall or cover 41 is swingable about the horizontal axis adjacent to an upper region of the front cover, as indicated in phantom in FIG. 2. The front wall is further swingable upwardly and forwardly generally to a horizontal disposition which opens the front of the bracket 10 for receiving an end portion of the headrail 16 moved rearwardly through the front region of the bracket. As indicated, the headrail 16 may rest on the bottom wall 11, being positively retained against forward withdrawal by the retaining flange or lip 40. However, the headrail may be raised over the lip for removal by deliberate manipulation.

The front wall or cover 41 may be provided on its side flange 42, in a lower region thereof, with a detent element or dimple 46, for complementary engagement with a detent element or dimple 47 provided in a lower region of depressed side wall portion 35. The mating elements 46 and 47 may serve to removably retain the front wall or cover 41 in its generally vertical, closed position.

As the bracket 10 is generally overhead, the vertical space between the upper edge of front wall 41 and top wall 21 will be obscured or unnoticed, while this space, and notch 14, 15 facilitates full upward swinging movement of the front wall for maximum access into and out of the bracket by a headrail.

It will now be appreciated that the headrail bracket of the instant invention effectively insures the elimination of falling headrails and blinds occasioned by improperly closed or unclosed bracket closures of the prior art, is extremely staunch and sturdy as being fabricated essentially of a single piece of metal stock, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A venetian blind headrail bracket comprising a bottom wall for supporting a headrail, a side wall upstanding from said bottom wall, a rear wall upstanding from said bottom wall, a top wall spaced over said bottom wall extending between said side and rear walls, mounting means on at least one of said walls for mounting to a desired surface, an upstanding forward lip on the forward edge of said bottom wall for retaining a supported headrail on said bottom wall, against forward dislodgement from said bottom wall without deliberate raising over said lip, a front cover upstanding from said bottom wall in covering relation with a supported portion of a headrail, and pivot means mounting said front cover for swinging movement out of said covering relation.

2. A venetian blind headrail bracket comprising a bottom wall for supporting a headrail, a side wall upstanding from said bottom wall, a rear wall upstanding from said bottom wall, a top wall spaced over said bottom wall extending between said side and rear walls, mounting means on at least one of said walls for mounting to a desired surface, an upstanding forward lip on said bottom wall for retaining a supported headrail on said bottom wall, a front cover upstanding from said bottom wall in covering relation with a supported portion of a headrail, and pivot means mounting said front cover for swinging movement out of said covering relation, said lip upstanding from the forward edge region of said bottom wall to a height spaced from said top wall sufficiently to pass therebetween the end portion of a headrail.

3. A venetian blind headrail bracket according to claim 2, said mounting means comprising fastener receiving openings in said side, rear, and top walls; said bottom wall being open to afford access to said top wall.

4. A venetian blind headrail bracket according to claim 1, said pivot means being generally horizontal and located at an upper region of said cover for upward swinging opening movement of the cover toward the plane of said top wall.

* * * * *